US006447141B1

(12) United States Patent
Waldmann

(10) Patent No.: US 6,447,141 B1
(45) Date of Patent: Sep. 10, 2002

(54) MOUNT FOR A PROTECTIVE TUBING LAMP

(75) Inventor: Gerhard Waldmann, Dauchingen (DE)

(73) Assignee: Herbert Waldmann GmbH & Co. (DE)

( * ) Notice: Subject to any disclaimer, the term of this patent is extended or adjusted under 35 U.S.C. 154(b) by 0 days.

(21) Appl. No.: 09/555,152

(22) PCT Filed: Dec. 10, 1998

(86) PCT No.: PCT/EP98/08059

§ 371 (c)(1),
(2), (4) Date: Jul. 17, 2000

(87) PCT Pub. No.: WO99/39136

PCT Pub. Date: Aug. 5, 1999

(30) Foreign Application Priority Data

Jan. 28, 1998 (DE) ..... 298 01 316 U

(51) Int. Cl.[7] ..... F21S 8/00

(52) U.S. Cl. ..... 362/147; 362/217; 362/371; 362/432; 248/207; 248/316.1

(58) Field of Search ..... 362/147, 217, 362/371, 370, 432; 248/207, 316.1, 316.5

(56) References Cited

U.S. PATENT DOCUMENTS

| | | | | | |
|---|---|---|---|---|---|
| 4,653,716 | A | * | 3/1987 | Sakaguchi | 248/316.5 |
| 4,728,071 | A | * | 3/1988 | Salacuse | 248/316.5 |
| 5,564,815 | A | * | 10/1996 | Littman et al. | 362/147 |
| 5,622,347 | A | * | 4/1997 | Nourry | 248/316.5 |
| 6,132,061 | A | * | 10/2000 | Andrus et al. | 362/217 |

FOREIGN PATENT DOCUMENTS

| | | |
|---|---|---|
| DE | 37 23 867 A | 1/1989 |
| FR | 1 538 568 A | 7/1968 |

* cited by examiner

*Primary Examiner*—Sandra O'Shea
*Assistant Examiner*—Ronald E. DelGizzi
(74) *Attorney, Agent, or Firm*—Eugene E. Renz, Jr.

(57) ABSTRACT

The invention concerns a mounting bracket to securely hold elongated tubular lamp members. The mounting bracket has a stationary part which can be fixed to a static structure, and a movable part which is detachably fixed to the stationary part in such a way that both parts fix the tubular lamp in place.

1 Claim, 2 Drawing Sheets

MOUNT FOR A PROTECTIVE TUBING LAMP

The present invention pertains to a mount for a protective tubing lamp having a stationary part which can be attached e.g. to a ceiling and a part being pivotable around a hinge, said pivotable part being removably fastened to said stationary part6 in such a way that the two parts hold the protective tubing lamp securely in place.

Protective tubing lamps of this type are frequently used for light strip installations. In light strip installations, the protective tubing lamps are lined up in a row with practically no space between them. This means that it is extremely difficult to remove one of the individual protective tubing lamps or units so that one of fluorescent tubes, for example, can be replaced.

Protective tubing lamps of this type are frequently used for light strip installations. In light strip installations, the protective tubing lamps are lined up in a row with practically no space between them. This means that it is extremely difficult to remove one of the individual protective tubing lamps or units so that one of fluorescent tubes, for example, can be replaced.

The invention is therefore based on the task of providing a mount of the general type indicated above which makes it possible for a protective tubing lamp to be replaced quickly and easily at all times.

With a mount of the general type indicated above, this task is accomplished according to the invention by providing the stationary part, with a substantially C-shaped first sidepiece for receiving the protective tubing lamp, said first side-piece having a stop next to the by hinge which holds the pivotable part in position after the pivotable part has been disconnected from said stationary part and has been swung out around the hinge as center of rotation.

It is advantageous for the pivotable part to be connected to the stationary part in such a way that it cannot be lost and preferably in such a way that it can still be removed by means.

The subclaims refer to advantageous embodiments of the invention.

Of course, it is possible to provide the hinge at any point on the mount. It is advantageous, however, for the hinge to be located at the free end of the first sidepiece.

The shape of the parts is arbitrary. It is advantageous, however, to adapt the parts to the shape of the protective tubing lamp. This can be done by designing the first sidepiece and the movable part as the two halves of a clamp, which hold the protect tubing lamp.

It is obvious that the two parts can be connected to each other detachably in many different ways. It is advantageous, however, for the stationary part to be connected detachably to the pivotable part by a screw connection, located opposite the hinge.

To avoid the use of additional tools, the screw connection can comprise of a thumb screw.

The procedure for removing the protective tubing lamp, furthermore, can be made much simpler by providing the first sidepiece with a stop next to the hinge. This stop holds the pivotable part in position after the pivotable part has been disconnected from the stationary part and swung out around the hinge as center of rotation. Thus the protective tubing lamp can be moved over laterally to the swung-out pivotable part while remaining parallel to its original position and then removed in a suitable,manner.

According to another advantageous embodiment of the invention, a second sidepiece of the C-shaped stationary part extends essentially in a straight line, and a connecting web, which connects the two sidepieces, is essentially perpendicular to the second sidepiece.

It is favorable for a first plane which connects the base to the free end of the first sidepiece to extend essentially parallel to the second sidepiece. According to another embodiment of the invention, a second plane, which connects the two ends of the pivotable part, coincides with the first plane after the pivotable part has been disconnected from the stationary part and pivoted outward around the hinge.

To improve the support of the protective tubing lamp, the two parts can be provided with support elements.

The stability of the mount can be increased by providing a reinforcing layer, which rests against both the second sidepiece and the connecting web.

The mount can be made of metal or plastic, as circumstances dictate.

Additional advantages and features of the present invention can be derived from the following description of an embodiment and from the drawings, to which reference will be made:

Figure 1:
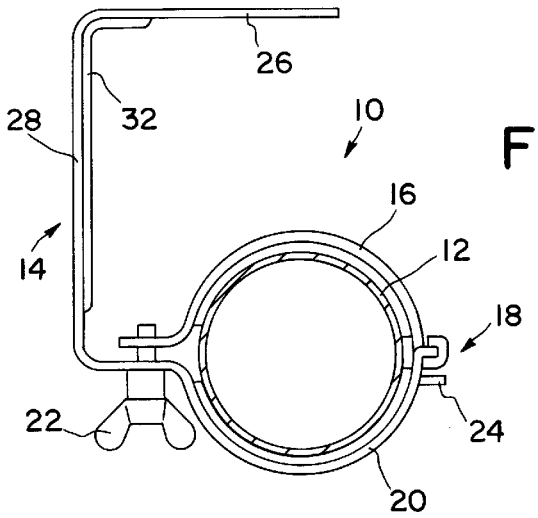
FIG. 1 shows a cross section of a mount, in which a protective tubing lamp has been installed in the ready-to-operate state.

FIG. 1 shows a mount 10 for a protective tubing lamp 12 in cross section. This mount 10 consists of a stationary part 14, which can be attached to, for example, a ceiling, and a pivotable part 16, which is fastened in a detachable manner to the stationary part 14. The pivotable part 16 is connected to the stationary part 14 by a hinge 18, this hinge 18 being located at the free end of a first sidepiece 20 C-shaped of the and stationary part 14, Opposite the hinge 18 is a screw connection 22 is provided so that the two parts 14 and 16 can be connected and disconnected; this screw connection consists of a thumb screw 22. Of course, the two parts 14, 16 can also be connected to each other by some other type of device such as a latch.

Figure 2:
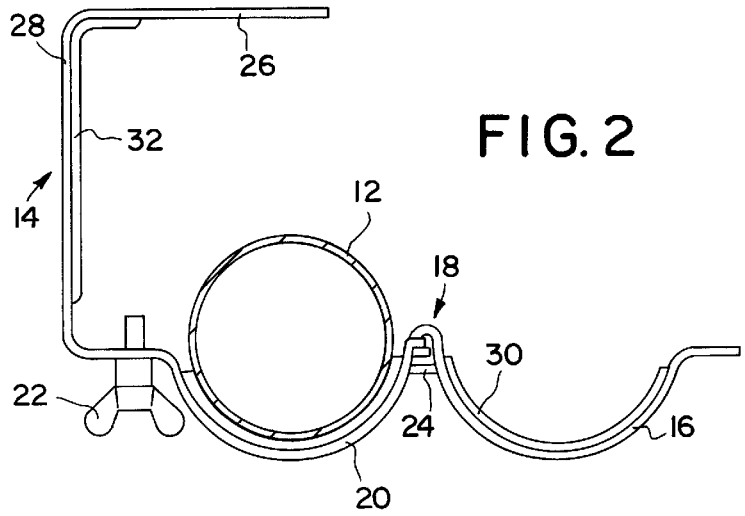
FIG. 2 shows a cross section similar to FIG. 1 after the pivotable part has been swung outward.
Figure 3:
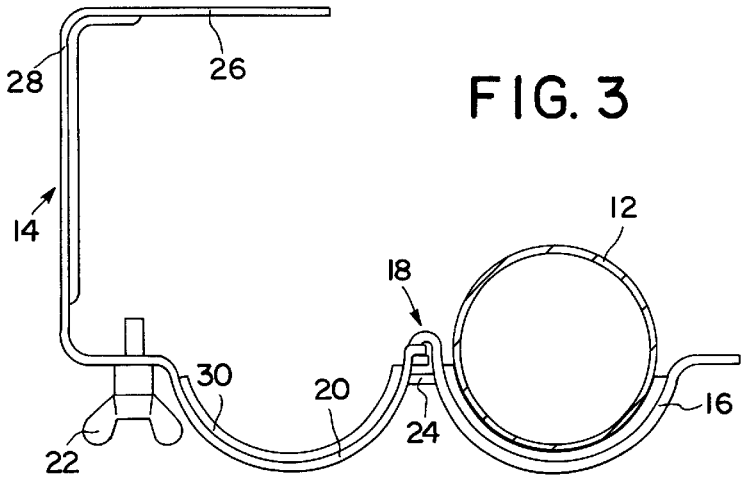
FIG. 3 shows a cross section similar to FIG. 2 after the protective tubing lamp has been moved over into the swung-out movable part.

As can be seen from FIGS. 1–3, the stationary part 14 is essentially in the form of a "C". The first sidepiece 20 is designed to receive the protective tubing lamp 12.

Although it would be possible to conceive of many different shapes, the first sidepiece 20 and the pivotable part 16 are designed as the two halves of a clamp, to hold the protective tubing lamp 12 is held in place.

So that the pivotable part 16 will assume a predetermined position after it has been swung outward, the first sidepiece 20 has a stop 24 next to the hinge 18. According to the design of the mount 10 shown in FIGS. 1–3, this stop is designed in such a way that a first plane connecting the base to the free end of the first sidepiece 20, this plane extending in the present case essentially parallel to the second sidepiece 26, coincides with a second plane connecting the two ends of the pivotable part 16 after the pivotable part 16 has been disconnected from the stationary part 14 and swung outward around the hinge 18.

In this position, it becomes very easy to shift the protective tubing lamp 12 over to the pivotable part 16.

To improve the reliability with which the protective tubing lamp is held in place and protected from impact, the two parts 14, 16 can also be lined with support elements 30.

To increase the stiffness of the C-shaped stationary part 14, a reinforcing pleat 32 is provided in the area of the second sidepiece 26 and over a certain portion of the connecting piece 28 perpendicular to the sidepiece. This pleat can even extend as far as the thumb screw 22.

Figures 4, 5:
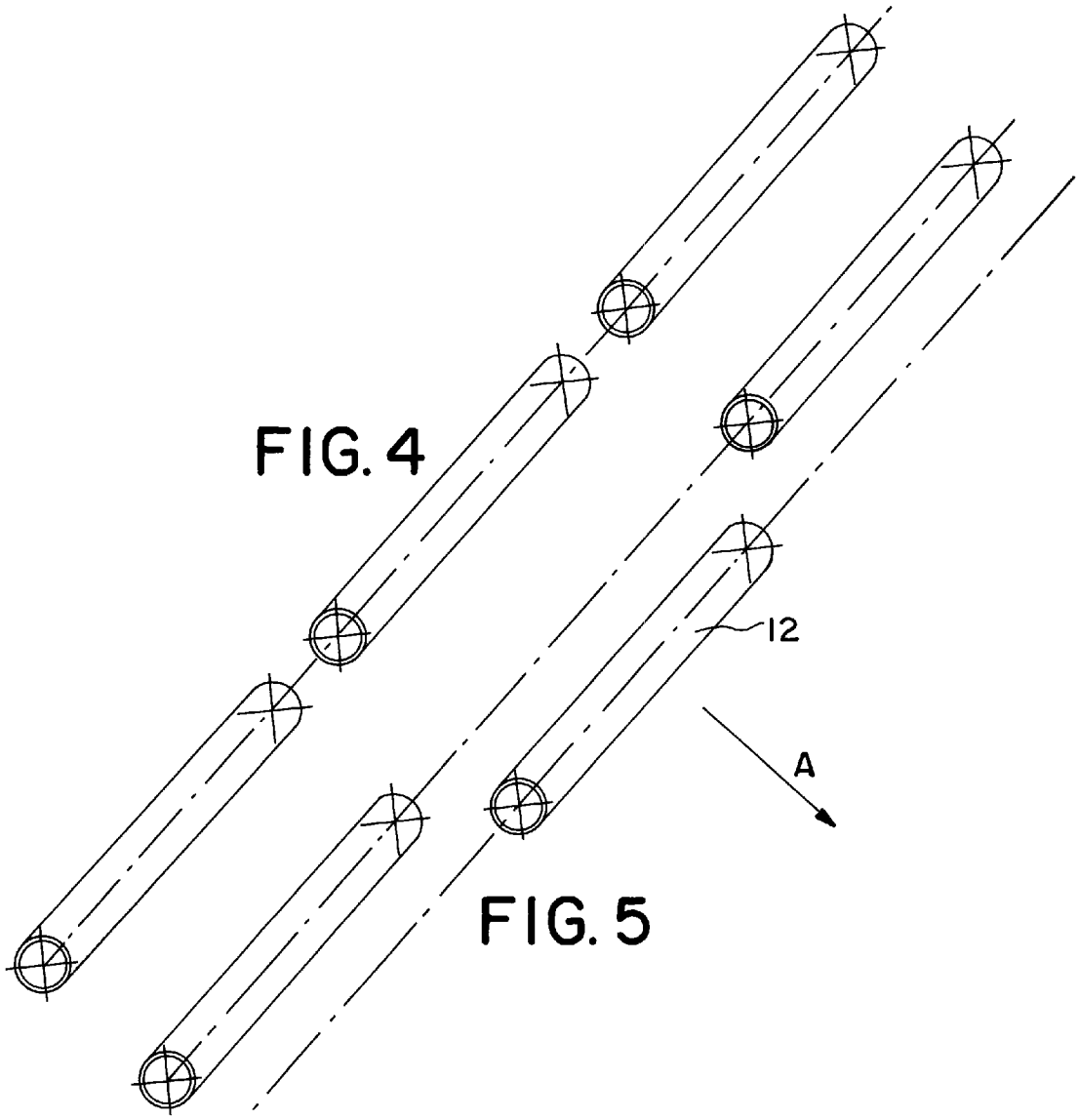
FIG. 4 shows a schematic diagram of protective tubing lamps arranged to form a light strip.
FIG. 5 shows a diagram similar to FIG. 4 after one of the protective tubing lamps has been removed from the course of the light strip installation by the use of the mount (not shown) according to FIGS. 1–3 so that it can be replaced.

FIGS. 4 and 5 illustrate the procedure for removing and replacing a protective tubing lamp 12.

As already said above, it is not an easy matter to replace one of the lamps in a light strip installation, because the adjacent protective tubing lamps make it impossible to pull the defective fluorescent tube or lamp out in the axial direction.

This difficulty is eliminated in the case of a light strip installation according to FIG. 4 in that the protective tube 12 of the lamp to be replaced can now be removed, as shown in FIG. 5, from the line of the light strip installation in the direction of arrow A. So that this can be done, the screw connection or thumb screw 22 is first disconnected, and then the pivotable part 16 is swung out from the stationary part 14 around the hinge 18. Now the protective tube 12 of the lamp to be replaced can be moved over to the swung-out pivotable part 16.

The lamp to be replaced can now be pulled out in the axial direction from the protective tube 12. which is resting on the movable part; then a new lamp can be introduced into the protective tube, again in the axial direction.

The entire protective tubing lamp can also be removed and replaced.

List of Reference Numbers

10 mount
12 protective tubing lamp
14 stationary part
16 movable part
18 hinge
20 1st (free) sidepiece
22 screw connection, thumb screw
24 stop
26 2nd sidepiece
28 connecting websupport
30 element
32 reinforcing pleat

What is claimed is:

1. Mounting bracket for an elongated tubular lamp comprising a stationary trough member of semi-circular trough cross section, a pivotable trough member (16) of semi-circular cross section hingedly (18) secured to said stationary trough member and adapted to be removably secured to said stationary trough member to embrace and hold the tubular lamp securely in place, means defining a stop (24) adjacent the hinge connection (18) and operable when the pivotable trough member (16) is pivoted to an open position to position the trough members side by side so that the upper of edges of the trough members lie in a common plane.

* * * * *